US009549646B2

(12) United States Patent
Ray et al.

(10) Patent No.: US 9,549,646 B2
(45) Date of Patent: Jan. 24, 2017

(54) WIPES DISPENSER

(75) Inventors: Eugene W. Ray, Barberton, OH (US); Michael J. Gmerek, III, Massillon, OH (US)

(73) Assignee: GOJO Industries, Inc., Akron, OH (US)

( * ) Notice: Subject to any disclaimer, the term of this patent is extended or adjusted under 35 U.S.C. 154(b) by 859 days.

(21) Appl. No.: 12/963,208

(22) Filed: Dec. 8, 2010

(65) Prior Publication Data

US 2012/0145737 A1 Jun. 14, 2012

(51) Int. Cl.

| | |
|---|---|
| ***B65D 83/08*** | (2006.01) |
| ***A47K 10/38*** | (2006.01) |
| *A47K 10/32* | (2006.01) |

(52) U.S. Cl.

CPC ..... *A47K 10/3818* (2013.01); *B65D 83/0805* (2013.01); *A47K 2010/3266* (2013.01)

(58) Field of Classification Search

USPC ..... 221/33, 47, 55, 61–63, 303, 304,221/306–310, 312 C

See application file for complete search history.

(56) References Cited

U.S. PATENT DOCUMENTS

| | | | | |
|---|---|---|---|---|
| 3,002,668 | A * | 10/1961 | Castelli | 225/52 |
| 4,180,160 | A | 12/1979 | Ogawa et al. | |
| 4,651,895 | A * | 3/1987 | Niske et al. | 221/63 |
| D305,865 | S * | 2/1990 | Zutler | D9/619 |
| 5,560,514 | A * | 10/1996 | Frazier | 221/63 |
| 6,158,614 | A * | 12/2000 | Haines et al. | 221/63 |
| 6,182,858 | B1 * | 2/2001 | Hartog | 221/63 |
| D450,211 | S * | 11/2001 | Santoni et al. | D6/518 |
| 6,409,034 | B2 * | 6/2002 | Schorner | 215/237 |
| 6,412,656 | B1 * | 7/2002 | Placik | 221/33 |
| 6,905,025 | B2 * | 6/2005 | Morin | 206/494 |
| 7,018,473 | B2 | 3/2006 | Shadrach | |
| D542,652 | S * | 5/2007 | Moribata et al. | D9/435 |
| 7,318,949 | B2 | 1/2008 | Shadrach | |
| 7,806,292 | B2 * | 10/2010 | Simkins | 221/63 |
| 2003/0132237 | A1 * | 7/2003 | Jeffrey Krok | 221/63 |
| 2007/0215632 | A1 * | 9/2007 | Bendor et al. | 221/63 |

FOREIGN PATENT DOCUMENTS

| | | |
|---|---|---|
| DE | 8707614 | 9/1988 |
| DE | 4006987 | 9/1991 |
| NL | 8202693 | 3/1983 |
| WO | 2010054063 | 5/2010 |

* cited by examiner

*Primary Examiner* — Gene Crawford
*Assistant Examiner* — Kelvin L Randall, Jr.
(74) *Attorney, Agent, or Firm* — Renner Kenner Grieve Bobak Taylor & Weber

(57) ABSTRACT

Wipe dispensers are provided wherein particular wipe-gripping and wipe-ripping structures are provided to overcome problems encountered with the prior art. Particularly, gripping and ripping structures are provided to prevent the removal of more than one wipe at a time from a dispenser and to prevent a following wipe from falling back into the interior of a container when separated from a lead wipe being removed from the container. In particular embodiments, structures are provided to avoid pinching an individual's finger when feeding a wipe up through the gripping and ripping structures. In yet other particular embodiments, a boss is provided to prevent wipes from bunching up during the dispensing thereof.

13 Claims, 9 Drawing Sheets

WIPES DISPENSER

FIELD OF THE INVENTION

The present invention generally relates to wipes dispensers. More particularly, the present invention relates to wipes dispensers having feed slit configurations suitable to prevent wipes from falling back into the wipes container and for facilitating the individual removal of wipes so as to prevent multiple wipes from being drawn from the container during a dispensing action. This invention also relates to the provision of structures to prevent wipes from bunching up at a feed slit and frustrating the removal of wipes through a dispensing orifice.

BACKGROUND OF THE INVENTION

Wipes dispensers are now in widespread use to provide individual wipes for various applications. Wipes dispensers typically include a container holding a plurality of wipes that are individually dispensed through an aperture in the container. The containers may be rigid plastic containers or flexible containers, for example, those made out of foil materials. The plurality of wipes may be provided on a roll, with individual wipes being defined between perforations in the roll. The plurality of wipes might also be provided as individual wipes interleaved together, much like a common box of tissues. The perforated roll and interleaved structures are provided so that pulling a lead wipe through a dispensing aperture in the container will cause another wipe to follow, and, once the lead wipe is removed and separated from the following wipe, the following wipe (hopefully) remains accessible at the exterior of the container, becoming the new lead wipe to thereafter be removed when desired. This is all very well known.

In order for the lead wipe to be separated from the following wipe, it is important that the following wipe be subjected to some type of resistance so that the lead wipe can be ripped off of the remainder at its perforations (in the case of a perforated roll of wipes) or disengage from being interleaved with the following wipe (in the case of an interleaved stack of wipes). Thus, a large number of different dispensing orifices exist in the prior art to provide resistance to the removal of wipes from a container. In some prior art embodiments, star-shaped or other specially-shaped apertures are provided so that, when a leading wipe is pulled through the aperture the special shape of the aperture serves to provide resistance to the following wipe, with the resistance intended to be sufficient for causing the separation of the lead wipe from the following wipe. In other embodiments, the aperture is provided as a slit in an elastomeric element, with the slit providing resistance to the pulling of the wipes out of the container.

These dispensing orifices of the prior art are provided to (a) separate individual wipes from a perforated web or interleaved stack of wipes, and (b) hold the lead wipe in such a manner that it is easily accessed for removal, when desired. That is, the dispensing orifice not only serves to separate a lead wipe from a following wipe but also to prevent the following wipe from falling back into the container, where the user would then have to take steps to access the interior of the container in order to access the wipe. However, it is well known that the dispensing orifices of the prior art often fail to separate a lead wipe from a following wipe, allowing what is herein termed a "roping" of the plurality of wipes. Roping occurs when separation is not achieved and multiple wipes are pulled from the container as a continuous string or rope. This is perhaps more common with a perforated roll of wipes but can occur with interleaved wipes as well. This leads to waste when only one wipe is desired, and is therefore not acceptable to the end user. When the dispensing orifice does successfully separate a lead wipe from a following wipe it serves what is termed herein an "anti-roping" function.

It is also well known that the dispensing orifices of the prior art often cause a lead wipe to separate from a following wipe too early, before the lead end of the following wipe has exited the interior of the container through the dispensing orifice. If this occurs, the following wipe remains inside the container, which must then be opened to access the wipes. The dispensing orifice thereby fails to serve what is termed herein an "anti-fallback" function.

Those familiar with the prior art will readily appreciate that the dispensing orifices do not always serve the anti-fallback and anti-roping functions. Indeed, it is quite common for the average user to pull more than one wipe from the interior of the container because the dispensing orifice has failed to separate a line of perforation or an interleaved connection. It is also common for the dispensing orifice to disconnect the wipes in such a way that the following wipe remains under the dispensing orifice and is not exposed at the exterior of the container, thus requiring the user to access the interior of the container to access the wipe. Quite simply, the dispensing orifices of the prior art fail to adequately and consistently perform both the anti-roping and anti-fallback features for which they are intended. The present invention seeks to provide a wipes dispenser having structures sufficient to consistently provide both anti-roping and anti-fallback functions.

Upon the initial purchase of a wipes dispenser containing a bulk supply of wipes, or, alternatively, in those instances when a wipe falls back into the interior of the wipes container, the user must access the bulk supply of wipes and feed the lead wipe through the dispensing orifice. Many dispensing orifices are formed in planar structures of generally rigid material, and, when the user inserts the lead wipe through the dispensing orifice by pressing the lead wipe up through the orifice with his or her finger, the planar structures in which the orifice is defined are deformed, and the finger is pinched upon retraction, as the rigid material returns to the planar structure. For example, the well known dispensing orifice structure in U.S. Pat. No. 6,554,156 presents a grip orifice defined by peripheral surfaces that spread under finger pressure and then move closer together as the finger is removed, thus pinching the finger. This is an annoyance to the end users, and the art would benefit from grip orifice structures that do not pinch a finger when a lead wipe is fed therethrough in a direction from the interior of the container to the exterior.

In a perforated roll of wipes, the wipes are fed to the dispensing orifice from the center of the roll. This is well known. As the string of wipes is fed from the center of the roll, the plurality of wipes tend to kink and twist and, at times, overlap and stick together, particularly when the wipes are wet. This twisting and bunching can result in multiple wipes bunching up directly under the dispensing orifice, and this can significantly increase the amount of force that must be applied to pull a lead wipe through the dispensing orifice. Additionally, when the wipes bunch up under the dispensing orifice it is more likely that the lead wipe will separate underneath the dispensing orifice and result in fallback of a following wipe. Thus, the art would benefit from structures serving to reduce or eliminate this tendency of the wipes to bunch up underneath the dispensing orifice.

When creating dispensing orifice structures, it is preferred that the structures be simple to manufacture. When somewhat rigid plastic materials are employed, it is preferred that the dispensing orifice structures be capable of being manufactured through simple open-and-close molds. Thus, in addition to addressing the issues raised above with respect to dispensing orifices, the art will benefit by providing dispensing orifices that solve one or more of the above problems and also can be made through molding in a simple open-and-close mold.

SUMMARY OF THE INVENTION

In one embodiment, this invention provides a wipes dispenser including a container having an interior holding a plurality of wipes. The wipes are interconnected such that pulling on a lead end of a lead wipe will cause a following wipe to also be pulled and follow the lead wipe. An aperture is defined in the container and a semi-rigid bridge member spans the aperture and extends above the aperture to define a bridge apex of the bridge member. A feed slit is formed in the bridge member and communicates with the interior of the container through the aperture. The feed slit presents a slit apex and extends downwardly from the slit apex to a terminal slit end that is lower than the slit apex. The plurality of wipes are removed from the container by being pulled through the feed slit, which separates a lead wipe from a following wipe as the lead wipe is pulled through the feed slit. In some embodiments, the bridge member is arcuate, and, in others, is a rounded dome covering the aperture. In other embodiments, the feed slit is sinusoidal, extending above and below a baseline of the feed slit to provide peaks and valleys that define wipe-spreading teeth.

In other embodiments, a wipes dispenser is provided comprising a container having an interior holding a plurality of wipes that are interconnected such that pulling on a lead end of a lead wipe of the plurality of wipes causes a following wipe of the plurality of wipes to also be pulled and follow the lead wipe. An aperture is defined in the container and an anti-bunching boss surrounds and extends downwardly from the aperture toward the plurality of wipes, the wipes being pulled against the anti-bunching boss as wipes are pulled through the aperture, the pulling of the wipes against the anti-bunching boss urging a following wipe to remain behind its respective lead wipe to prevent wipes from bunching up at the aperture.

In yet another embodiment, this invention provides a wipes dispenser including a container having an interior holding a plurality of wipes. In this embodiment, the plurality of wipes are provided as a roll of wipes with each wipe interconnected to neighboring wipes at lines of perforation. The roll of wipes defines a hollow core, and the wipes are removed from the wipes dispenser by being pulled from the core such that pulling on a lead end of a lead wipe causes a following wipe to also be pulled and follow the lead wipe. The feeding of wipes off of the core causes the wipes to extend from the core with the side edges of the wipes presenting a helical structure with a given wipe overlapping with itself and with a following wipe or wipes. An aperture is defined in the container and an anti-bunching boss surrounds and extends downwardly from the aperture toward the plurality of wipes. The wipes are pulled against the anti-bunching boss as wipes are pulled through the aperture, and the anti-bunching boss urges a side edge of the plurality of wipes to be further distanced from the lead end of the lead wipe being pulled through the aperture. In particular adaptations the aperture surrounded by the anti-bunching boss is a grip orifice. In other embodiments, a grip orifice is aligned above the aperture that is surrounded by the anti-bunching boss.

In the embodiment of the preceding paragraph, because the wipes are fed off of a core of a roll of wipes, the feeding of wipes off of the core causes the wipes to extend from the core in a cone-like structure, from a wider base at the top edge of the core to a narrower tip at the aperture through which the wipes are pulled. This is particularly true as the diameter of the core increases as wipes are removed from the roll. The anti-bunching boss can serve to reduce the tapering of this cone-like structure, the cone being redefined from the wider diameter at the lowest edge of the anti-bunching boss to the narrow tip at the aperture. This ensures a more consistent presentation of the wipes to the aperture and further assists in preventing wipes from bunching up at the aperture and clogging the same. In particular adaptations the aperture surrounded by the anti-bunching boss is a grip orifice. In other embodiments, a grip orifice is aligned above the aperture that is surrounded by the anti-bunching boss.

In still further embodiments, this invention provides a wipes dispenser comprising a container having an interior holding a plurality of wipes that are interconnected such that pulling on a lead end of a lead wipe of said plurality of wipes causes a following wipe of said plurality of wipes to also be pulled and follow said lead wipe. An aperture is defined in the container and a semi-rigid bridge member spans the aperture and extends outside and above the plane of the aperture to define a bridge apex of the bridge member. A feed slit is provided in the bridge member communicating with the interior of the container through the aperture, and the feed slit presents a slit apex and extends downwardly from the slit apex to a terminal slit end that is lower than the slit apex. A plurality of wipes are removed from the container by being pulled through the feed slit, the feed slit separating a lead wipe from a following wipe as the lead wipe is pulled through the feed slit. An anti-bunching boss surrounds and extends downwardly from the aperture toward the plurality of wipes. The pulling of the wipes against the anti-bunching boss urges a following wipe to remain behind its respective lead wipe to prevent wipes from bunching up at the aperture.

In yet another embodiment, this invention provides a wipes dispenser including a container having an interior holding a plurality of wipes. The plurality of wipes are provided as a roll of wipes with each wipe interconnected to neighboring wipes at lines of perforation. The roll of wipes defines a hollow core, and the wipes are removed from the wipes dispenser by being pulled from the core such that pulling on a lead end of a lead wipe causes a following wipe to also be pulled and follow the lead wipe. The feeding of wipes off of the core causes the wipes to extend from the core with the side edges of the wipes presenting a helical structure with a given wipe overlapping with itself and with a following wipe or wipes. An aperture is defined in the container and a semi-rigid bridge member spans the aperture and extends outside and above the plane of the aperture to define a bridge apex of the bridge member. A feed slit is formed in the bridge member and communicates with the interior of the container through the aperture. The feed slit presents a slit apex and extends downwardly from the slit apex to a terminal slit end that is lower than the slit apex. The plurality of wipes are removed from the container by being pulled through the feed slit, which separates a lead wipe from a following wipe as the lead wipe is pulled through the feed slit. An aperture is defined in the container and an anti-bunching boss surrounds and extends downwardly from the aperture toward the plurality of wipes. The wipes are pulled against the anti-bunching boss as wipes are pulled through the aperture, and the anti-bunching boss urges a side edge of the plurality of wipes to be further distanced from the lead end of the lead wipe being pulled through the aperture.

In still a further embodiment, this invention provides a wipes dispenser including a container having an interior holding a plurality of wipes. The wipes are interconnected such that pulling on a lead end of a lead wipe will cause a following wipe to also be pulled and followed the lead wipe. An aperture is defined in the container for feeding wipes therethrough from the interior to the exterior of the container. A plurality of rip fingers extend from a periphery of the aperture to extend above the aperture and define a rip aperture through which a lead wipe is pulled to separate it from a following wipe. A plurality of grip fingers are provided, each such grip finger being formed as a cut-out in one of the plurality of grip fingers and extending above the aperture in the container and below the remainder of the rip finger in which it is formed. The plurality of grip fingers provide a grip aperture that holds a following wipe and prevents it from falling back into the interior of the container. In particular embodiments, the plurality of grip fingers include distal ends that are bent upwardly to facilitate the feeding of a wipe therethrough by an individual's finger, without pinching the individual's finger.

In yet another embodiment, this invention provides a wipes dispenser including a container having an interior holding a plurality of wipes. The wipes are interconnected such that pulling on a lead end of a lead wipe will cause a following wipe to also be pulled and followed the lead wipe. An aperture is defined in the container for feeding wipes therethrough from the interior to the exterior of the container. A plurality of rip fingers extend from a periphery of the aperture to extend above the aperture and define a rip aperture through which a lead wipe is pulled to separate it from a following wipe. A plurality of grip fingers are provided below said plurality of rip fingers such that a wipe fed from the interior to the exterior of the container passes first past the plurality of grip fingers and then the plurality of rip fingers. The plurality of grip fingers include distal ends that are bent upwardly to facilitate the feeding of a wipe therethrough by an individual's finger, without pinching the individual's finger. The plurality of grip fingers provide a grip aperture that holds a following wipe and prevents it from falling back into the interior of the container.

In particular adaptations of the preceding embodiments of wipes dispensers having a plurality of rip fingers and a plurality of grip fingers, the grip fingers and rip fingers are semi-rigid. In other embodiments, the rip fingers are three or four in number. In embodiments where the rip fingers are four in number, they are generally triangular in shape and provide a generally cross-shaped rip aperture. In other embodiments, the grip fingers are generally triangular, extending from connection to a respective rip finger at a wider base to a narrower distal end. In particular embodiments, an anti-bunching boss is also employed.

DETAILED DESCRIPTION OF ILLUSTRATIVE EMBODIMENTS

Figure 1:
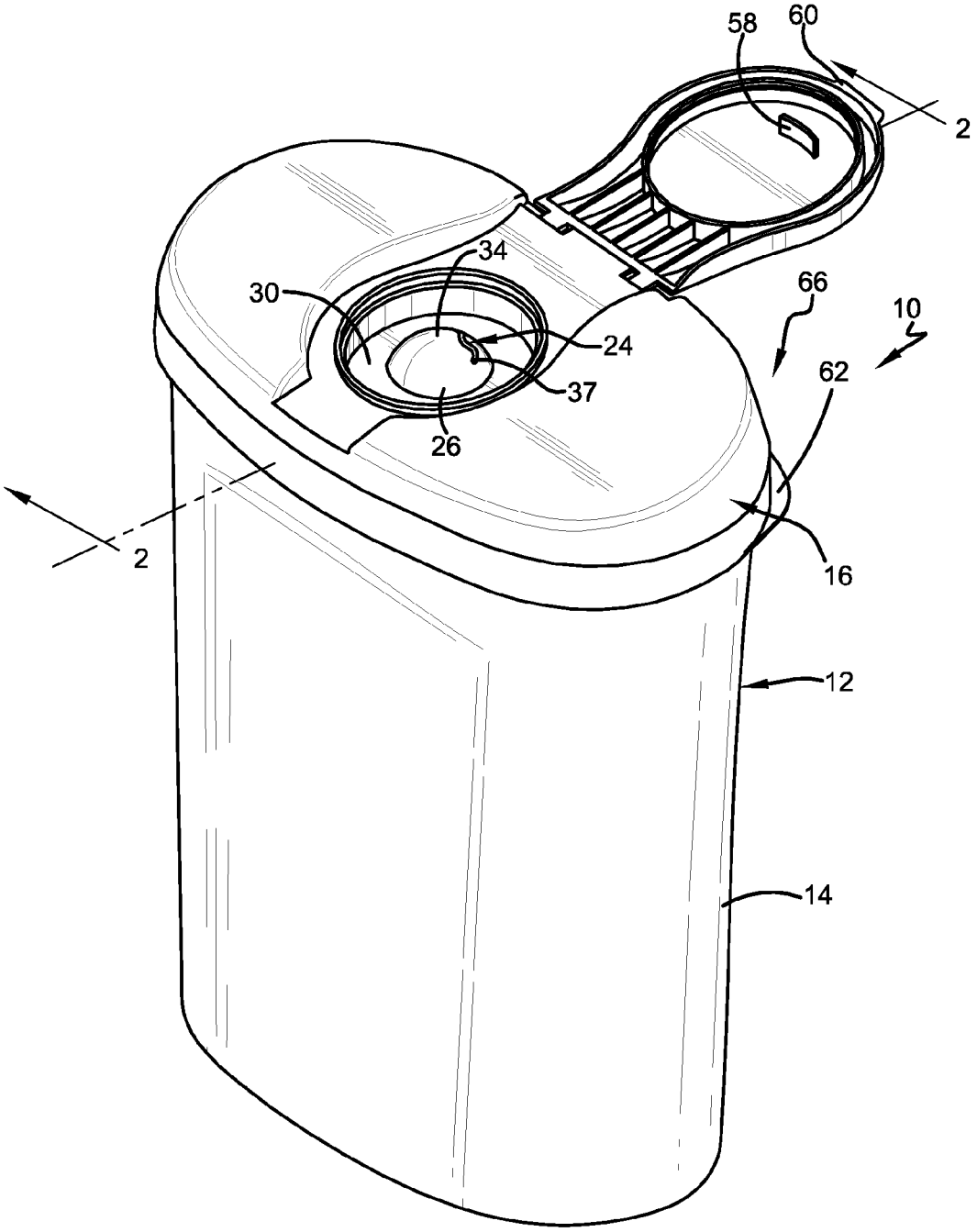
FIG. 1 is a perspective view of a first embodiment of a wipes dispenser in accordance with this invention.
Figure 2:
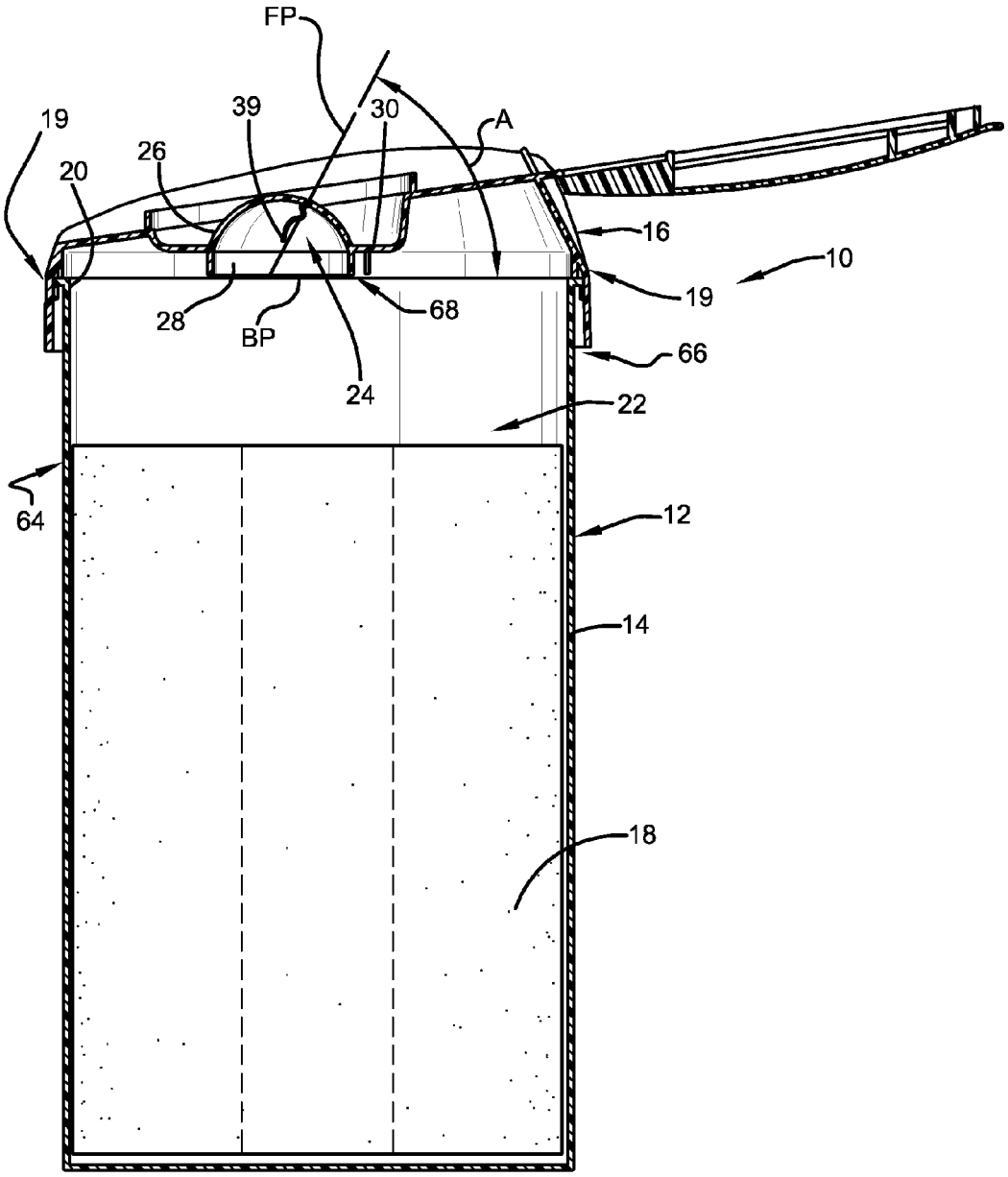
FIG. 2 is a cross-sectional view of the wipes dispenser of FIG. 1 taken along the line 2-2 in FIG. 1.
Figure 3:
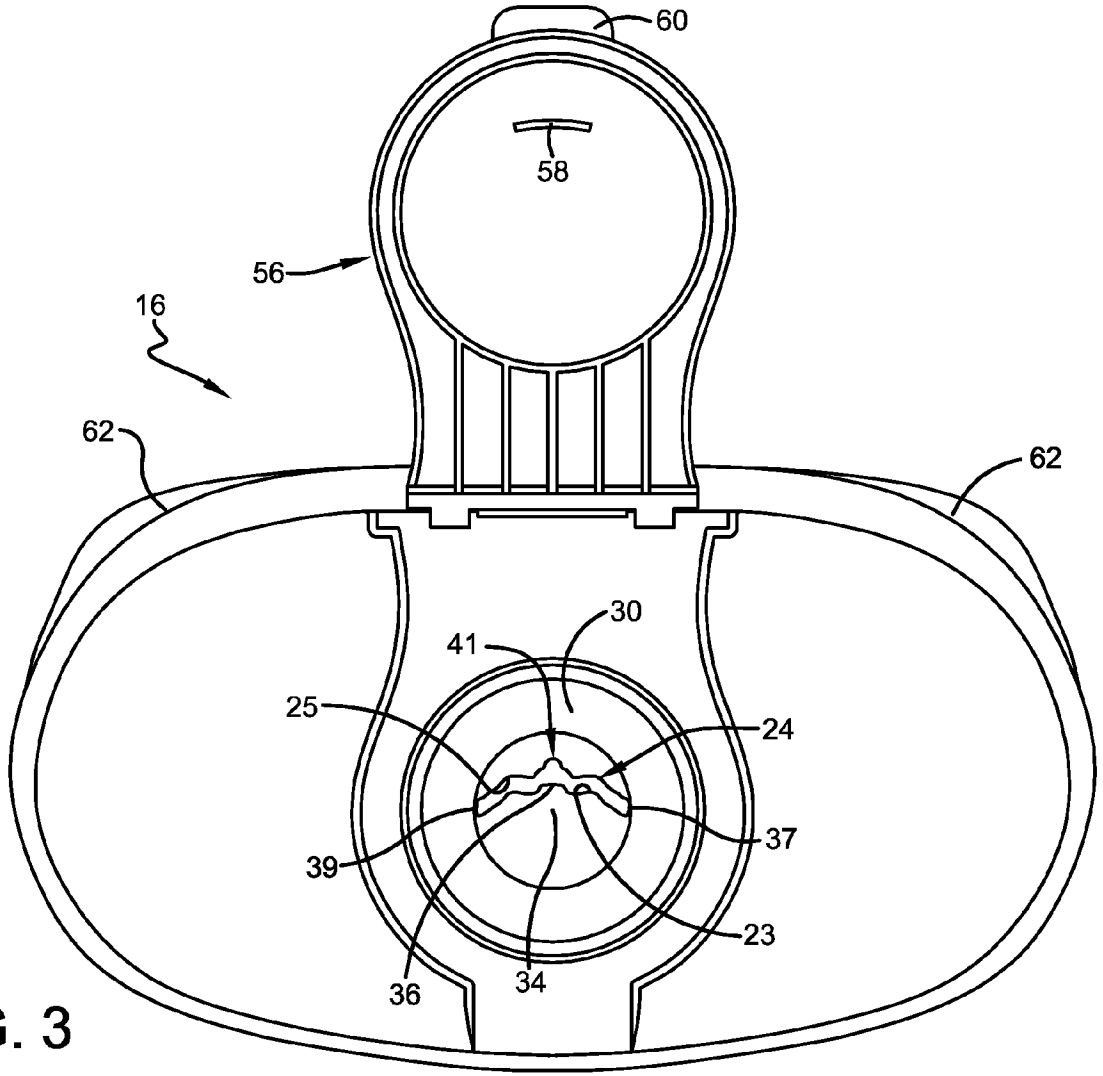
FIG. 3 is a top plan view of the lid portion of the wipes dispenser of FIG. 1.

Referring now to FIGS. 1-3, a first embodiment of a wipes dispenser in accordance with this invention is shown and designated by the numeral 10. The wipes dispenser 10 includes a container 12 formed of a receptacle 14 and a lid 16. The container 12 retains a plurality of wipes 18. In this specific embodiment, the container 12 is formed of the receptacle 14 and the lid 16, and the lid 16 is removable at a snap-fit connection 19 about the open end 20 of the receptacle 14. The lid 16 is preferably removable so as to permit a user to access the plurality of wipes 18 and thread a lead wipe thereof through the lid 16 as will be described more fully below. The plurality of wipes 18 are shown as a common roll of wipes, wherein each wipe is separated and defined by lines of perforation between neighboring wipes such that pulling on a lead wipe will cause the next wipe, the "following wipe," to be pulled and follow the lead wipe.

Figure 4:
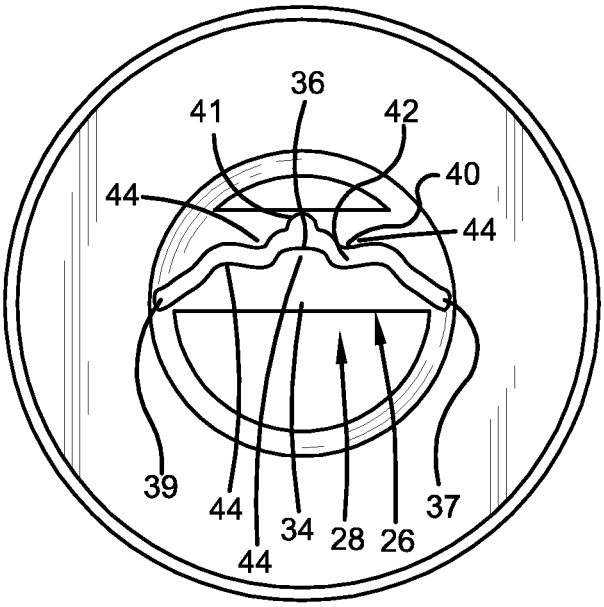
FIG. 4 is an alternative embodiment of a bridge member in accordance with this invention.

The plurality of wipes 18 are held in the interior 22 of the container 12. A feed slit 24 in the lid 16 provides communication between the interior 22 and the exterior of the container 12, and it is through this feed slit 24 that the wipes are removed from the container and separated one from the other. As seen in FIG. 2, the feed slit 24 is formed in a bridge member 26 that spans an aperture 28 (FIG. 2) defined in a surface of the container 12, and more particularly defined in a recessed surface 30 of the lid 16 forming a portion of the container 12. The bridge member 26 extends outside and above the plane of the aperture 28, and, in this particular embodiment, the bridge member 26 is a dome that completely surrounds the aperture 28. But, as shown in FIG. 4, it should be appreciated that the bridge member 26 could instead span across only a portion of the aperture 28, such that one or more openings 32 are provided in communication with aperture 28.

The bridge member 26 extends above and outside the plane of the aperture 28 to define a bridge apex 34. Although shown as the apex of a dome structure in the embodiment of FIGS. 1-3, the bridge apex might also be provided as the apex of a generally triangular bridge member 26 or through some other shape of bridge member spanning the aperture 28. The feed slit 24, being formed in the bridge member 26, also presents its own slit apex 36, and extends down from the slit apex 36 to first and second (or, for ease of reference in the Figures, right and left) terminal ends 37, 39 that are lower than the slit apex 36. Again, though shown curved along a dome shape, the feed slit 24 could be provided in a generally triangular bridge member or through some other shape of bridge member 26 spanning the above aperture 28 to provide an apex. Although they could be so formed, there is no requirement that the slit apex 36 pass through the bridge apex 34. Indeed, in the embodiment of FIGS. 1-3, the slit apex 36 is lower than the bridge apex 34.

It is preferred that the wipes be raked against either the top side 23 or bottom side 25 of the feed slit 24 when a wipe is pulled therethrough to separate a lead wipe from a following wipe. Thus, though the feed slit 24 may extend at virtually any angle, it is preferred that it extend at an angle that makes it highly likely that a user will rake wipes against the top side 23 or bottom side 25 of the feed slit 24 as opposed to drawing the wipe out substantially parallel to the angle at which the feed slit 24 extends. In a portable, countertop wipes dispenser embodiment such as that in FIGS. 1-3, the feed slit extends at an angle A of from 5 to 90 degrees to the surface on which the dispenser 10 rests. Angle A is represented in FIG. 2 as measured between a base plane bp, which is generally parallel to the surface on which the dispenser rests, and a feed plane fp, which is the plane that extends through the center or centerline of the feed slit. In particular portable, countertop wipes dispenser embodiments, the feed slit extends toward the rear 66 of the dispenser 10, as shown in FIGS. 1-3, and, in this way, the lead wipe is pulled toward the front of the dispenser (as is common) and thus the wipes must rake against the top side 23 of the feed slit 24. In a particular portable countertop wipes dispenser embodiment, the feed slit extends at from 20 to 70 degrees, and, in other embodiments, from 30 to 60 degrees. In other embodiments, the feed slit extends at an angle of from 45 to 60 degrees, and, in a specific embodiment at 60 degrees. The cap 56, being positioned so as to pivot open at a hinge at the rear 66 of the dispenser 10 can serve to encourage the pulling of the wipe against the top side 23 of the feed slit, because most (if not all) users tend to position and treat the pivoting portion of a container cap as the rear of the container. Also, the cap 56 would interfere with pulling wipes toward the rear 66. Because the wipes are to be raked against the feed slit 24, in preferred embodiments, it is formed in a bridge member that is a semi-rigid member. By "semi-rigid" it is intended that the material not be readily capable of taking on altered shapes, except that slight flexing is permitted as, for example, that experienced by plastic materials that have defined shapes but can be slightly deformed upon the application of pressure and retain their defined shape upon the removal of the applied pressure. "Semi-rigid" is intended specifically to distinguish from those materials that are purposefully flexible and capable of taking on substantially different geometries due to applied stresses. A semi-rigid material, in accordance with this invention, will tend to maintain or revert to its established geometry after an applied stress is removed, as for example the stress applied in feeding a wipe through the feed slit.

Although this invention is not limited to such a feed slit, the feed slit 24 is advantageously sinusoidal, with the feed slit 24 extending above and below a centerline to provide peaks 40 and valleys 42 that define wipe-spreading teeth 44. For purposes of this disclosure, the angle at which the feed slit 24 extends is determined with reference to this centerline 38. The wipe-spreading teeth 44, as the name implies, serves to cause a wipe pulled through the feed slit 24 to spread out between the right and left terminal ends 37, 39. The wipe is pulled or raked against the wipe-spreading teeth 44, which then cause overlapping portions of the wipe to be spread apart by being drawn down over the side slopes between the peaks 40 and valleys 42. This design spreads the wipe away from a cylindrical shape (see FIG. 8 and related disclosures) by pulling the wipes over an arc. This exposes more perforations to the gripping and ripping structure of the slit 24 and therefore makes the wipes easier to separate.

Figure 5:
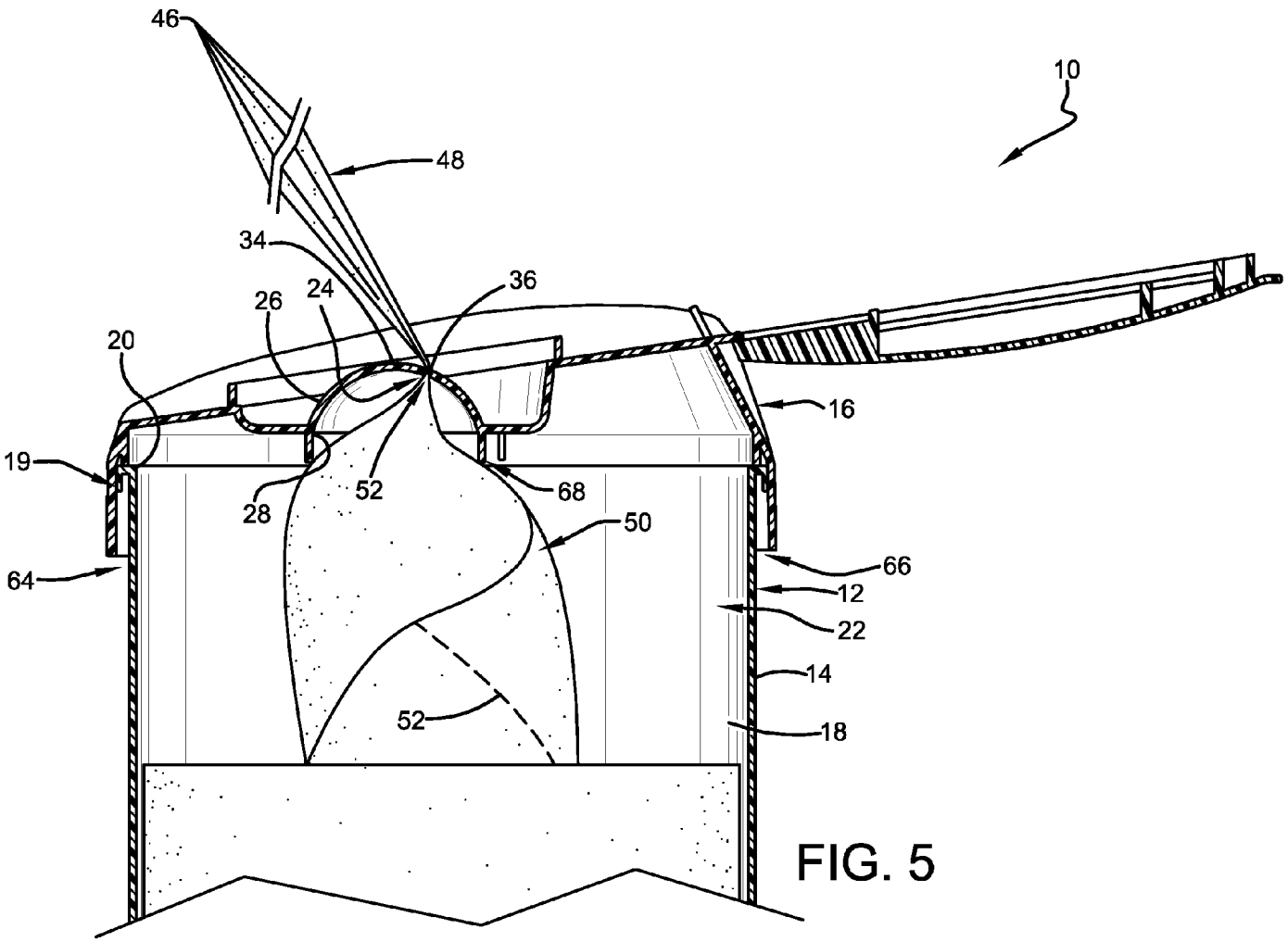
FIG. 5 shows the separation of a lead wipe from a following wipe by employing the wipes dispenser of FIGS. 1-3.

As seen in FIG. 5, in use, a lead end 46 of a lead wipe 48 extends through the feed slit 24, where it can be accessed by a user. Pulling on the lead end 26 draws the lead wipe 28 against the structure of the feed slit 24 and causes the remainder of the lead wipe 48 to follow and be removed from the container 12. The next wipe in the roll (or stack if a stack of wipes is employed) is to be understood as the following wipe 50, and it follows the lead wipe 48 when it is pulled. This is a result of the interconnection between the lead wipe 48 and the following wipe 50. The interconnection shown in this embodiment is a perforated interconnection as at perforations 52, but any appropriate interconnection can be employed, as for example in interleaved stacks of wipes. When the area of interconnection between the lead wipe 48 and the following wipe 50 is pulled against the feed slit 24, that area of association will be broken, disassociating the lead wipe 48 from the following wipe 50. In this particular embodiment, the area of interconnection is characterized by perforations 52 in a web of wipes, and when those perforations 52 are pulled against the feed slit 24, the lead wipe 48 is separated from the following wipe 50 along the perforations 52. It should be appreciated that the area of interconnection could also exist as an area of overlap between interleaved wipes in an interleaved stack, or as perforations between wipes joined in an interleaved stack.

Figure 6:
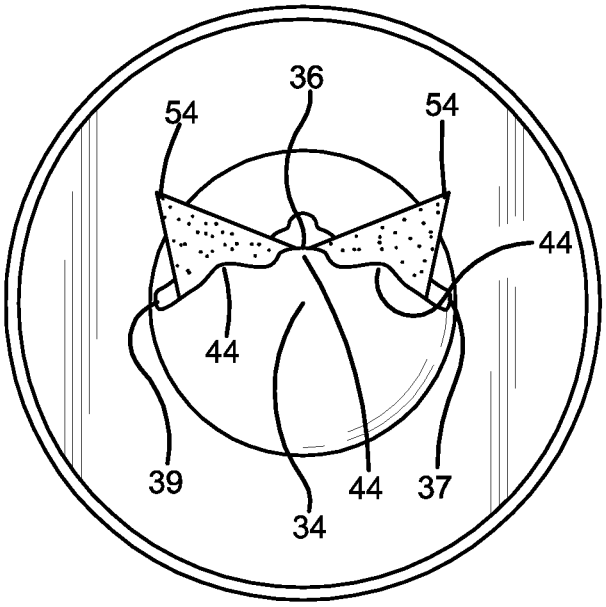
FIG. 6 is a perspective view showing the separation of a lead wipe from a following wipe, where the separation occurs directly at the apex of the feed slit.

By providing the feed slit 24 in a bridge member 26 to provide a slit apex 36, a suitable length of the following wipe 50 is left behind for access by the user, even if the lead wipe 48, separates directly at the slit apex 36. This is shown in FIG. 6, wherein ears 54 of the following wipe 50 are left behind and gripped by the feed slit 24 to prevent fall back of the following wipe 50, which can now be considered the new lead wipe now that lead wipe 48 has been disassociated with the plurality of wipes provided by the roll of wipes 18. The creation of the ears 54 is enhanced by the use of the sinusoidal feed slit 24 providing the wipe-spreading teeth 44, but this invention is not limited thereto.

Notably, the lead wipe will not always disassociate from the following wipe directly at the feed slit 24, and, instead, a small length of the following wipe might be pulled through the feed slit 24 before a suitable resistance to the pulling is establishes so as to break perforations or separate interleaved wipes. In such cases the dispenser 10 works perfectly to separate a lead wipe from a following wipe and present the following wipe as the new lead wipe for access. In some instances, the lead wipe will disassociate from the following wipe directly at the feed slit 24, as shown, and, while in prior art embodiments that could easily result in wipe fall back into the container, in this embodiment, at least a portion, such as ears 54, of the new lead wipe will not fall back and will remain outside the feed slit 24 for access when another wipe is desired.

It will be appreciated that a wipes dispenser such as dispenser 10 will be shipped and stored before an initial use with the cap 56 closed down over the bridge member 26 and feed slit 24, and with the first lead wipe in the plurality of wipes 18 retained completely below the feed slit 24. That is, it is general practice in the art that the plurality of wipes be retained completely within the container 12 such that a user must access the first lead wipe of the plurality of wipes and thread it through the feed slit 24 to present the wipes dispenser in the manner in which it is going to be used to remove individual wipes from the dispenser. Thus, upon an initial purchase of the wipes dispenser 10, the user removes the lid 16 and accesses the first lead wipe of the plurality of wipes 18. This first lead wipe is then inserted upwardly through the feed slit 24 to present a portion of the first lead wipe exteriorly of the lid member 16. The lid 16 is then fitted back on the receptacle 14 so that the wipes dispenser is ready for use.

Notably, due to the arcuate nature of the bridge member 26 in particular embodiments of this invention, the user can thread the first lead wipe through the feed slit 24 without pinching his or her finger. The bridge member 26 is preferably made of a rigid yet somewhat resilient plastics material such that finger pressure applied at underside of the feed slit 24 will cause the bridge member 26 to yield to such pressure, which, in turn, will cause the feed slit 24 to slightly warp and open to a greater extent than the feed slit 24 is open at rest. It should be specifically noted that "semi-rigid", as used herein, is to be understood as permitting such slight yielding to pressure in this manner, i.e., some slight reaction to an applied force is to be expressly acceptable in accordance with that term. For example, it is known that plastic materials can be formed to retain their shape but yet still yield to some applied force as indicated here with respect to pressure applied at the underside of the feed slit. Thus, simply by pressing a lead wipe against the underside of the feed slit 24, the feed slit 24 can open slightly to permit a portion of the wipe to extend out of the feed slit 24 where it can be grasped by the user and pulled to present the lead wipe for access and removal. This is an advantage for the user of the present invention in that, in wipes dispensers of the prior art, wherein the feed slits or other forms of grip orifices are presented in planar surfaces, the feed slit opens to finger pressure but then pinches down on the finger as it is retracted. The rounded shape to the underside of the bridge member 26 helps to ensure that the finger is not pinched even though a portion of a wipe is fed up through the feed slit 24 by the user's finger, which is then retracted. Stated another way, the present invention teaches feed slits that are formed in surfaces biased away from the load vector, and this prohibits or at least minimizes any pinching of one's finger. It should be appreciated that the "load vector" is established by the direction in which a wipe must be loaded through a feed slit or grip orifice, in this case, the load vector being along the feedplane fp (See FIG. 2). In particular embodiments, a feed gap 41 is provided in the feed slit 24 at the slit apex 36. This feed gap 41 is an expansion of the feed slit 24 that further separates the top side 23 and bottom side 25 thereof to better prevent the pinching of a finger that is loading a wipe up through the feed slit 24 by pressing at the feed gap 41.

In instances where the wipes are wet wipes, the lid 16 preferably includes a cap 56 that closes over the feed slit 24 and the bridge member 26 to seal the same against the drying effects of the general ambient atmosphere and prevent the plurality of wipes 18 from drying out. In the particular embodiment shown, the cap member 56 closes around and seals the recessed surface 30 of the lid 16. Additionally, the cap member 56 carries a stuffer tab 58 that can serve to stuff a lead edge of a lead wipe into the sealed-off volume between the cap member 56 and the recessed surface 30. If a portion of the lead wipe is permitted to extend outside of the cap member 56 and communicate with the ambient atmosphere, moisture within the plurality of wipes can be lost through capillary action or wicking, even though the cap member 56 is sealed down over the bridge member 26 and feed slit 24. The cap member 56 can provide a lifting tab 60, which an end user would use to open the cap member 56 off of the remainder of the lid 16 and provide access to the lead wipe held by the feed slit 24. Similarly, the lid 16 can include lifting tabs 62, which would permit an end user to remove the lid 16 from the receptacle 14. Of course, this invention could also be practiced with threaded cap and lid members and other means for securing cap and lid members.

Cap members such as that shown at 56 generally help to define a front and rear of the dispenser 10, as most users consider the front of the dispenser to be the end where the distal end of the cap resides when the cap member 56 is closed on the lid 16. Thus, the front of the dispenser 10 may be considered to be the side designated by the numeral 64, while the rear of the dispenser 10 may be considered to be the end of the lid proximate the numeral 66. This is mentioned because, in particular embodiments, such as that shown in FIGS. 1-3, the feed slit 24 extends along a baseline 38 that extends on an angle away from the user (i.e., away from the front 64 of the wipes dispenser and toward the rear 66 of the wipes dispenser. Although this particular positioning of the feed slit 24 is not required by the present invention, it facilitates the proper functioning as described above and shown in FIG. 5 inasmuch as the user will pull a lead wipe in the opposite direction of which the feed slit 24 extends, thus raking the wipe against the wipe-spreading teeth 44.

It will be appreciated that such dispensers as that taught above will serve both an anti-fallback and anti-roping function in that the feed slit will both grip a following wipe to prevent it from falling back into the container and will also provide significant resistance to the pulling of the wipes therethrough as to cause the wipes to disassociate and prevent roping.

In particular embodiments, the wipes dispenser further includes an anti-bunching boss 68 that surrounds and extends downwardly from the aperture 28 toward the plurality of wipes 18. The wipes are pulled against this anti-bunching boss 68 as wipes are being pulled through the feed slit 24, and the pulling of the wipes against the anti-bunching boss 68 urges a following wipe to remain behind its respective lead wipe, spreading them longitudinally to prevent the wipes from bunching up at the feed slit 24. The anti-bunching boss 68 imparts a slight resistance to movement of the wipes in the vertical direction. This tends to discourage the wipes from remaining overlapped to a significant degree as they they approach the feed slit. Overlapped wipes can bunch up at the feed slit and clog it, so the anti-bunching boss can improve the functioning of a wipes dispenser.

Figure 7:
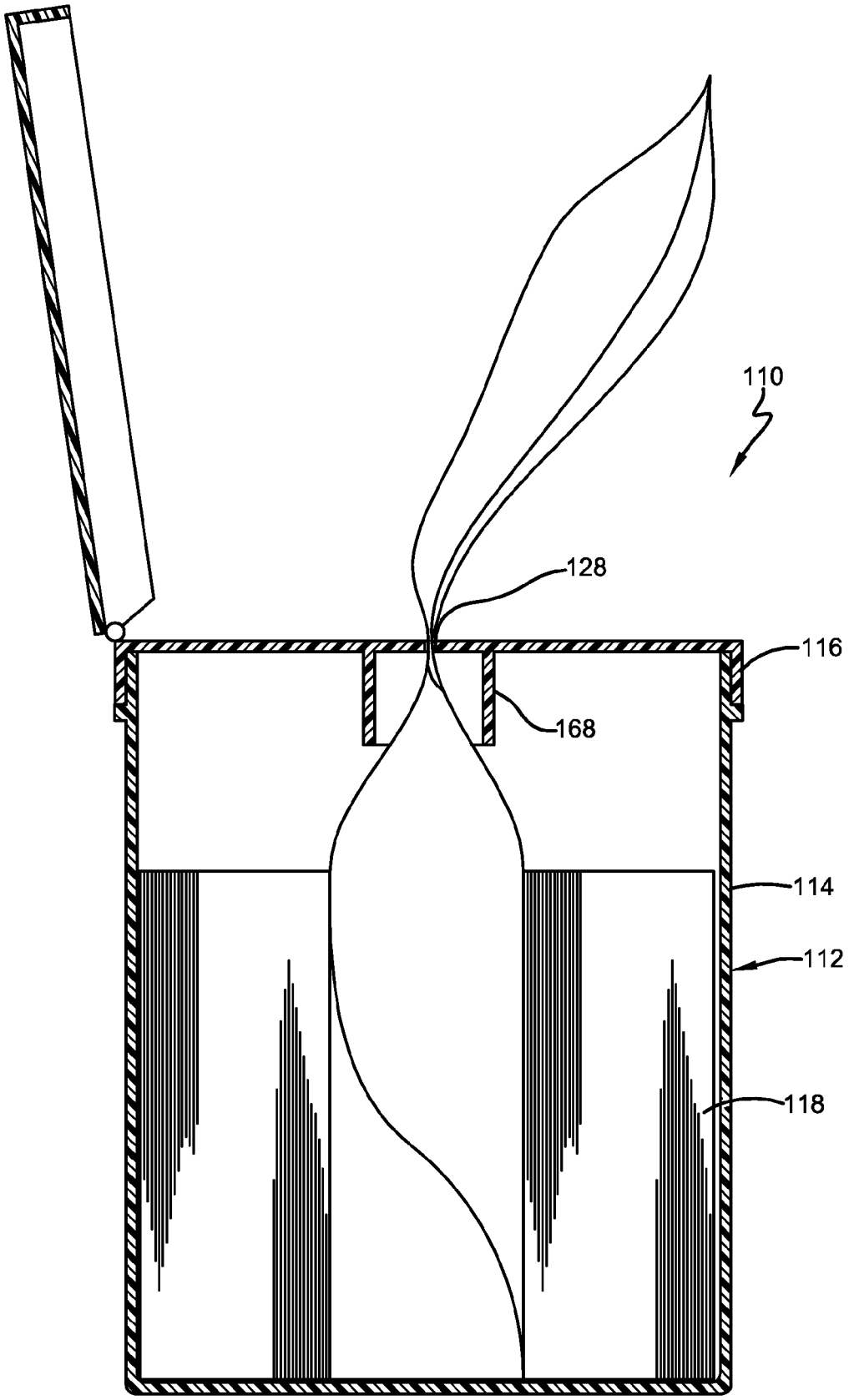
FIG. 7 is a perspective view of a second embodiment of a wipes dispenser in accordance with this invention, showing the use of an anti-bunching boss in association with a generic aperture 128 which may include gripping structures or ripping structures or gripping and ripping structures.

The anti-bunching boss 68 is, in fact, advantageous in of itself, without regard to the special structures of the bridge member 26 and the feed slit 24. Thus, wipes dispenser embodiments in accordance with the invention may include an anti-bunching boss provided to surround any generally known or hereafter designed feed orifices, including the vast multitude of feed orifices already provided in prior art products and/or described in prior art literature. Thus, with reference to FIG. 7, a wipes dispenser 110 is provided. The wipes dispenser 110 includes a container 112 formed of a receptacle 114 and a lid 116. The container 112 retains a plurality of wipes 118, and, as with container 12, may take virtually any form. An aperture 128 in the lid 116 provides communication between the interior 122 and the exterior of the container 112, and it is through this aperture that the wipes must pass in order to be removed from the container 112 for use by an end user. Thus, the aperture 128 may be provided as a common grip aperture or may be provided as another aperture, with gripping and/or ripping structures being provided elsewhere. In the particular embodiment, the aperture 128 is a grip orifice represented generically by a cross-slit. An anti-bunching boss 168 surrounds and extends downwardly from the aperture 128 toward the plurality of wipes 118. The wipes are pulled against this anti-bunching boss 168 as wipes are being pulled through the aperture 128, and the pulling of the wipes against the anti-bunching boss 168 urges a following wipe to remain behind its respective lead wipe to prevent the wipes from bunching up at the aperture 128 or elsewhere along the path on which the wipes are pulled.

Figure 8:
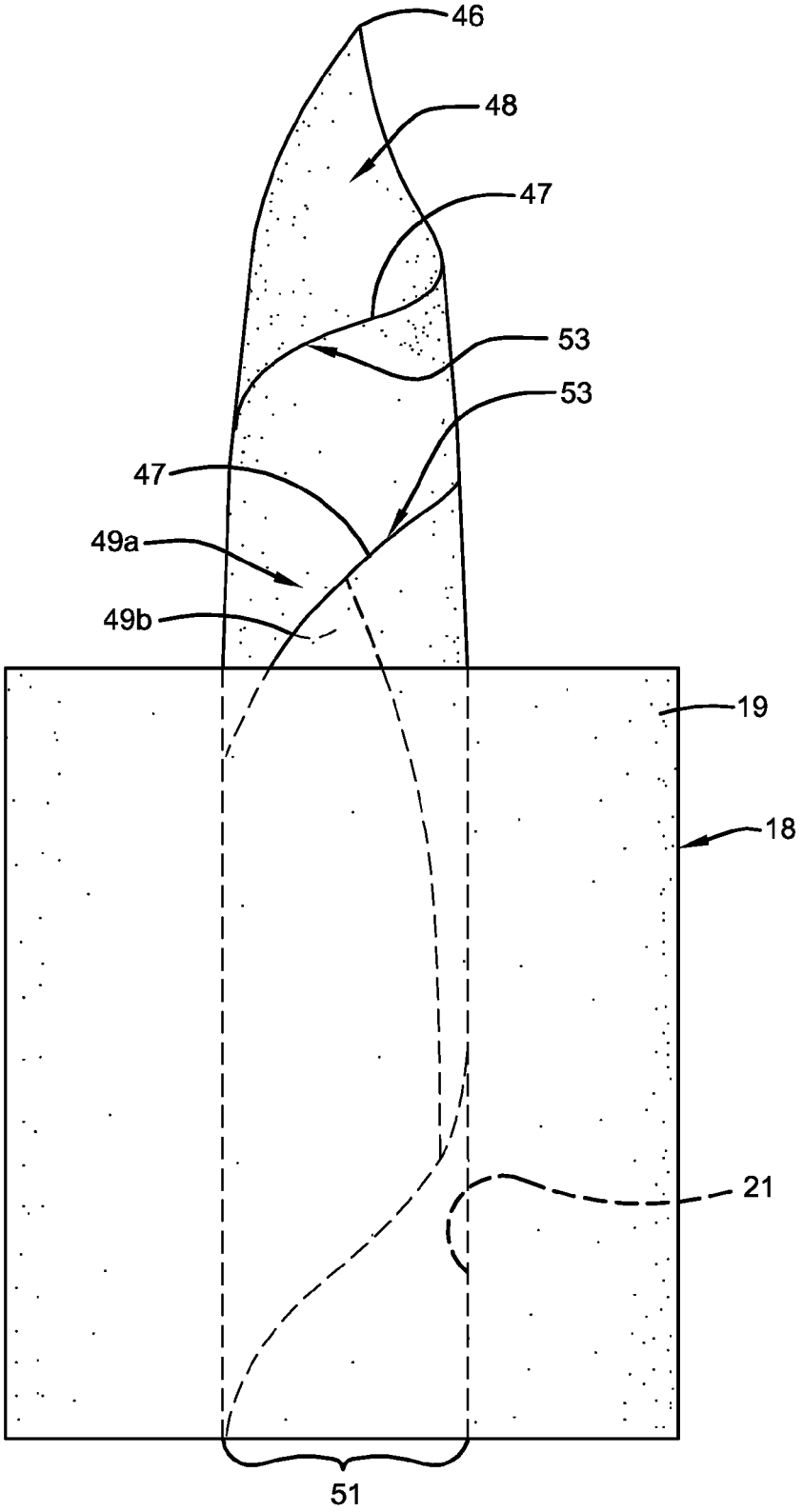
FIG. 8 is a side plan view of a roll of wipes in which wipes are feed from a hollow core.
Figure 9:
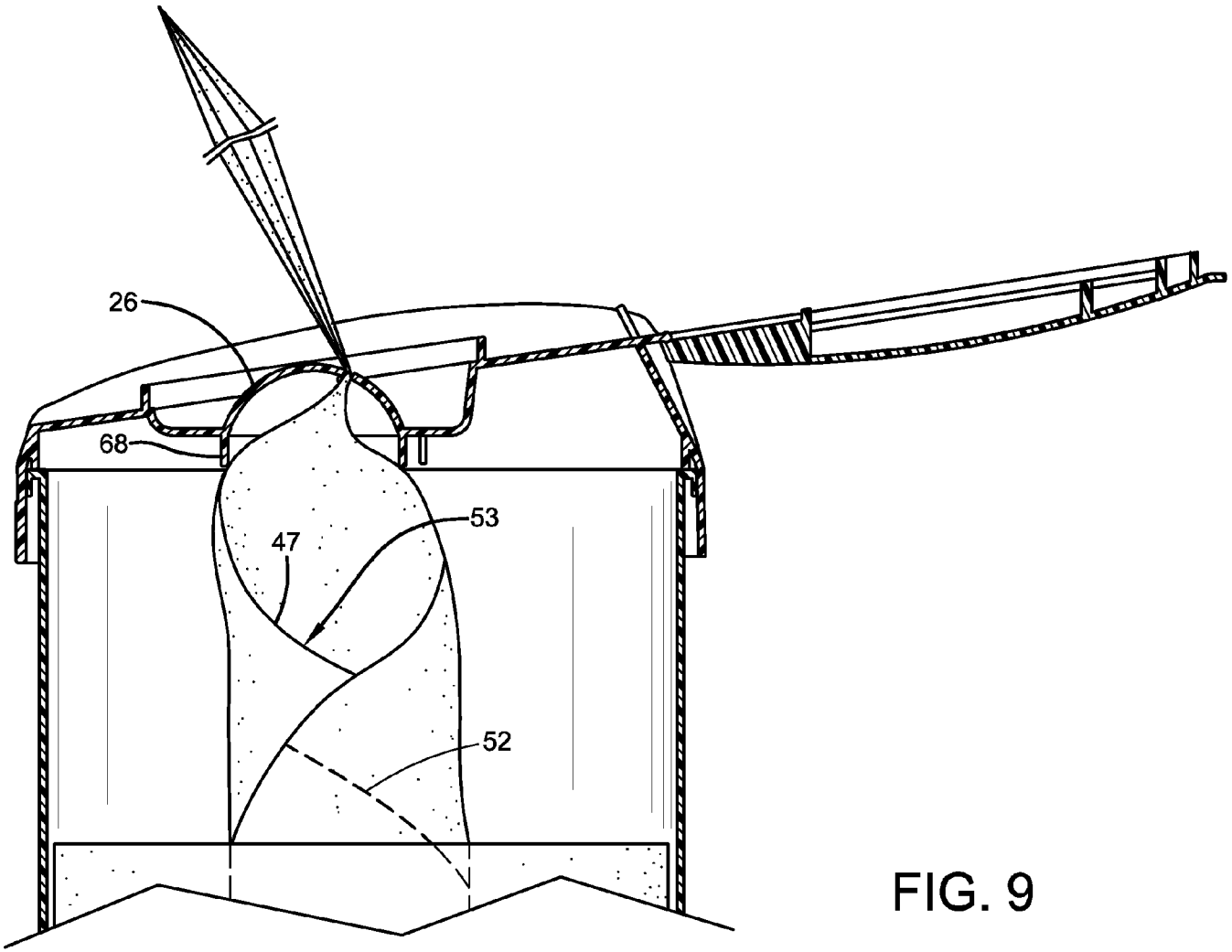
FIG. 9 is a cross-sectional view of the embodiment of FIG. 7, showing the affect of the anti-bunching boss on a roll of wipes such as that in FIG. 8.

In particular embodiments, a core-fed roll of wipes is employed, and the anti-bunching affects the roll in a particular manner, the specifics of which will be better appreciated with reference to the following description and FIGS. 8 and 9. In FIG. 8, a plurality of wipes 18 are provided as a roll of wipes 19 with each wipe interconnected to a neighboring wipe at lines of perforation 52. The roll of wipes 19 defines a hollow core 21, and the wipes are removed from the wipes dispenser by being by being pulled from the core 21 such that pulling on a lead end 46 of a lead wipe 48 causes a following wipe 50 to also be pulled from the core 21 and follow the lead wipe 48. The feeding of wipes off of the core 21 causes the wipes to separate from the core with the side edges 47 of the wipes presenting a helical structure 53, as shown, with a given wipe overlapping with itself and with a following wipe or wipes. Particularly when the core is small, the face 49*a* of a lead wipe 48 will overlap with itself and the face 49*b* of a following wipe 50. The overlapping of the wipes in this helical structure causes the wipes to bunch up at the feed orifices of the wipes dispensers in which the roll of wipes is employed, and this bunching up can frustrate the separation of a lead wipe from a following wipe and even clog the feed orifice. Additionally, it will be appreciated that the core base 51 widens as more wipes are removed from the roll 19 and the hollow core 21 becomes larger. As the core base 51 becomes wider, the generally tubular wipes structure approaching the feed slit 24 tapers at a more extreme angle, and this can also lead to a clogging or jamming of the feed slit 24.

Referring now to FIG. 9, it can be seen that the continuous side edge 47 of the roll of wipes is pulled against the anti-bunching boss 68 (or 168 in the embodiment of FIG. 7) as wipes are pulled through the aperture, and the anti-bunching boss 68 urges the elongation of the helical structure to decrease the density of the overlapping. At the joining of a lead wipe to a following wipe this urges a following wipe to remain behind a lead wipe such that they both do not bunch up at the feed slit. In more general terms, the wipes are pulled against the anti-bunching boss as wipes are pulled through the aperture, and the anti-bunching boss engages a portion of the side edge of the wipes to urge that side edge to remain behind the lead wipe being pulled through the aperture. The wipes are pulled against the anti-bunching boss as wipes are pulled through the aperture, and the anti-bunching boss urges a side edge of the plurality of wipes to be further distanced from the lead end of the lead wipe being pulled through the aperture. That is, as the lead end continues to be pulled away from the aperture and thus the anti-bunching boss, the side edge engaged by the anti-bunching boss tends to be drawn over and remain engaged with the anti-bunching boss, thus preventing bunching of wipes at the aperture.

The anti-bunching boss also normalizes the taper of the helical structure, because the taper is largely a function of the points of contact with the anti-bunching boss, at 169, which points of contact do not change, regardless of the angle at which the helical structure tapers toward those points. Less clogging and a more consistent separation of wipes is realized through the use of the anti-bunching boss 168.

It should also be appreciated that the pulling force exerted on the wipes is not distributed evenly throughout the very random cross section of the wipes being pulled toward and through the dispensing orifice. The wipes will be drawn from the container along a path of least resistance, and wrinkles, kinks and folds in the wipes that are outside this path may readily catch and bunch up at the dispensing orifice if not smoothed out, and the anti-bunching boss, through the engagement with the wipes as already described, tends to even out the wrinkles, kinks and folds to better present the wipes at the dispensing orifice.

Figure 10:
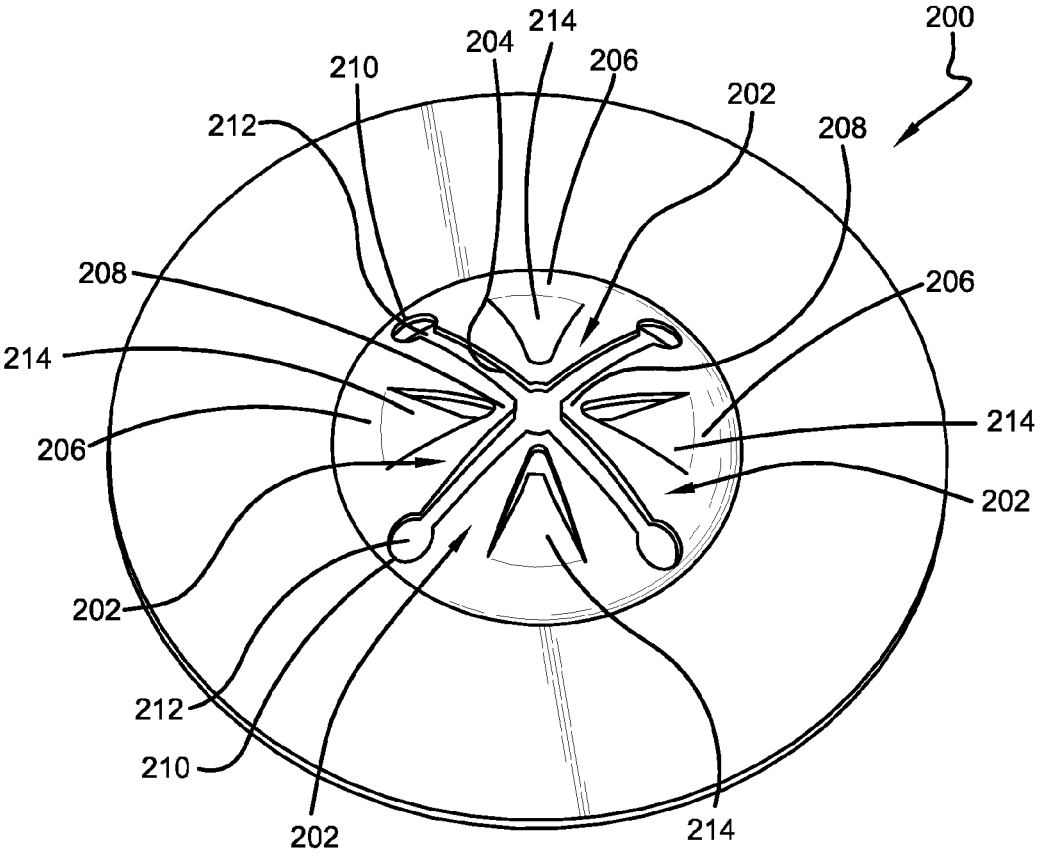
FIG. 10 is a general perspective view of an alternative gripping and ripping structure.
Figure 11:
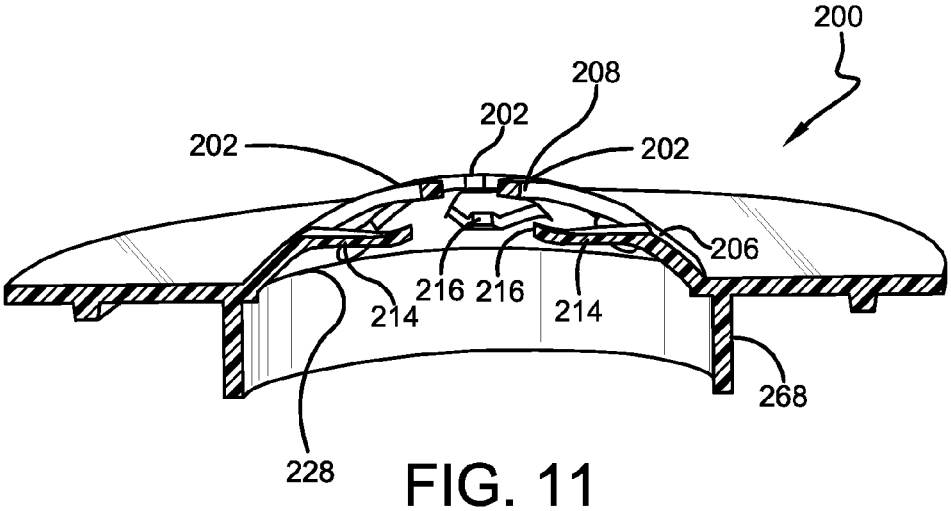
FIG. 11 is a cross-sectional view of the alternative gripping and ripping structure of FIG. 10.

FIGS. 10 and 11 provide an alternative gripping and ripping structure that could replace the gripping and ripping structure provided by the feed slit 24 and bridge member 26 of the embodiments in accordance with FIGS. 1-6 and the descriptions relating thereto. The substitution of the gripping and ripping structures of FIGS. 10 and 11 into a receptacle and lid combination or other type of container will be readily apparent to those of ordinary skill in the art, and, therefore, only the gripping and ripping structures are focused upon in the following description, with the understanding that the structure shown in FIGS. 10 and 11 would be incorporated to a container holding a plurality of wipes. Thus, this gripping and ripping structure 200 can be incorporated into a container to provide a plurality of rip fingers 202 spanning an aperture 228 that would be defined in a surface of the container, such as aperture 28 in the prior embodiment. The rip fingers 202 extend from a periphery of the aperture 228 to extend above the aperture 228 and define a rip aperture 204 through which a lead wipe is pulled to separate it from a following wipe.

A plurality of grip fingers 214 are provided below said plurality of rip fingers such that a wipe fed from the interior to the exterior of the container passes first past the plurality of grip fingers and then the plurality of rip fingers. The plurality of grip fingers provide a grip aperture that holds a following wipe and prevents it from falling back into the interior of the container. They are not intended to impart a ripping force (or separating force, in the case of interleaved but not interconnected wipes) to the wipes. The plurality of grip fingers are intended to give slightly to applied forces so as not to impart a ripping (separating) force. They instead flex and allow the wipes to be pulled therethrough, with the random cross section of the wipes interacting with the grip fingers so that the wipe is caught thereby and prevented from falling back into the container.

In the particular embodiment shown, four rip fingers 202 are employed, and each rip finger 202 is generally triangular in shape, extending from a wider base 206 about the aperture 228 to a narrower distal end 208 extending over the aperture 228. The sides of the four rip fingers 202 define therebetween a generally cross-shaped rip aperture 204. The distal ends 210 of the generally cross-shaped rip aperture 204 provide widened round apertures 212, which facilitate finger entry to access a wipe underneath the rip fingers 202. In particular embodiments, the widened round aperture 212 is positioned below the bottommost end of the plurality of grip fingers 214 such that, if the wipes do rip or separate at the grip fingers instead of at the rip fingers, it is likely that the wipe remaining at the gripping and ripping structure would be accessible at the apertures 212 to be pulled and repositioned through both the plurality of grip fingers and then the plurality of rip fingers.

It should be appreciated that the number of rip fingers and their particular shape are not to limit this invention. Additionally, in accordance with another embodiment, this invention could be practiced with three rip fingers of generally triangular shape and generally identical to provide a rip aperture formed of three well-defined slits. In particular embodiments, the rip fingers 202 extend over the aperture 228 to create a general domed structure.

In the particular embodiment shown, the plurality of grip fingers 214 are formed as cut-outs in each one of the plurality of rip fingers 202. The term "cut-outs" is not to imply that the grip fingers 214 are actually cut out from a given rip finger 202. Rather, as can be appreciated from the figures, they appear as if they could be formed by being cut out from an otherwise continuous rip finger structure, and the term cut-out is to be interpreted broadly to encompass such a structure. The plurality of grip fingers 214 extend above the aperture 228 and below the remainder of the rip fingers 202 in which they are formed. In particular embodiments, the plurality of grip fingers 214 have distal ends 216 that are bent upwardly to extend both upwardly and inwardly in a direction toward the apex of the structure defined by the plurality of rip fingers 202. The bent distal ends 216 facilitate the feeding of a wipe through the space between grip fingers 214 upwardly in a direction toward and through the rip aperture 204. The bent distal ends 216 also serve to avoid pinching an individual's finger when feeding a wipe upwardly between the grip fingers. The bent distal ends 216 also act as barbs that dig into a wipe to prevent it from falling back into the container from which the wipes are being fed.

When a lead wipe is fed through the grip fingers 214 and the rip fingers 202 and is accessed outside of the aperture 204, the wipe may be pulled in generally any direction to separate the lead wipe from the following wipe. The plurality of rip fingers 202 define a rip aperture 204 through which the lead wipe is pulled to separate it from the following wipe, the sides or distal ends 208 or both serving to engage a perforation connection or interleaved connection between the wipes to separate them. The plurality of grip fingers 214 serve to define a grip aperture 218 that is sufficient to hold a following wipe and prevent it from falling back into the interior of a container when the lead wipe is separated therefrom. In the event that the new lead wipe formed by separating a lead wipe from a following wipe is not accessible at the exterior of the gripping and ripping structure 200, the round apertures 212 defined at the distal ends of the rip aperture 204 permit and facilitate finger entry to access the wipe and pull it to expose it exteriorly of the grip and rip structure 200.

In accordance with an embodiment of this invention, the grip fingers also impart resistance to the wipes as they are dispensed, though this resistance is not enough to separate a lead wipe from a following wipe. Instead, the grip fingers will share the tear burden with the rip fingers. In accordance with such an embodiment, the grip fingers are made to have more flexibility than the rip fingers by forming the grip fingers with a different thickness. In some embodiments, the grip fingers will have a thickness that is from 70% to 90% of the thickness of the rip fingers. In other embodiments the grip fingers have a thickness of from 75% to 85% of the wall thickness of the rip fingers. In yet other embodiments, the grip fingers have a thickness that is 80% of the rip fingers. As mentioned with respect to prior embodiments and the use of the anti-bunching boss, the pulling force exerted on the wipes is not distributed evenly throughout the very random cross section of the wipes being pulled toward and through the plurality of grip fingers and plurality of rip fingers. The wipes will be drawn from the container along a path of least resistance, and wrinkles, kinks and folds in the wipes that are outside this path will be engaged by the more flexible grip fingers, which will act as force equalizers, giving and flexing in accordance with the stresses placed thereon in light of the aforementioned wrinkles, kinks and folds. This tends to present the wipes more consistently to the rip fingers to even out the required tear force (or separation force).

It will be appreciated that such dispensers as that taught above with respect to FIGS. 10 and 11 will serve both an anti-fallback and anti-roping function in that the plurality of grip fingers will grip a following wipe to prevent it from falling back into the container and the plurality of rip fingers will provide significant resistance to the pulling of the wipes therethrough as to cause the wipes to disassociate and prevent roping. As with prior embodiments, these dispensers may incorporate an anti-bunching boss 268.

Notably, the gripping and ripping structures disclosed and shown with respect to FIGS. 1-6 and those shown with respect to FIGS. 10 and 11 may all be formed in an open-and-close injection mold because each structure shown and described provides no impediments to insertion and removal of a core and cavity mold halves, and neither requires any slides or lifters.

It should be appreciated that although the receptacle 14 is shown as a bucket-type receptacle, it may take virtually any form, and can even be a flexible receptacle formed from suitable films as generally known in the art. In this invention, the roll of wipes, as shown at 18, can be replaced by virtually any plurality of wipes wherein individual wipes are associated in such a way that a following wipe follows a lead wipe as it is removed from the container. For example, an interleaved stack of wipes may be employed.

While particular embodiments of the present invention have been shown and disclosed in detail, it should be understood that the inventive concepts herein are not limited thereto or thereby. Indeed, any single feature of the dispensers and dispensing structures shown might be individually patentable or patentable in combination with other features. The claims will serve to define the scope of the invention.

What is claimed is:

1. A wipes dispenser comprising:

a container having an interior holding a plurality of wipes that are interconnected such that pulling on a lead end of a lead wipe of said plurality of wipes causes a following wipe of said plurality of wipes to also be pulled and follow said lead wipe;

an aperture defined through an exterior wall of said container;

a semi-rigid bridge member spanning said aperture and extending exteriorly beyond said exterior wall to define a bridge apex of said bridge member;

a feed slit in said bridge member communicating with the interior of the container through said aperture, said feed slit presenting a slit apex and extending downwardly from said slit apex to a right-side terminal slit end and to a left-side terminal slit end, wherein said slit apex, said right-side terminal slit end and said left-side terminal slit end define a feed plane extending away from said exterior wall, said slit apex being located on said feed plane at a distance further away from said exterior wall than the location of both said left-side terminal slit end and said right-side terminal slit end on said feed plane, and wherein said plurality of wipes are removed from said container by being pulled through said feed slit, said feed slit separating a lead wipe from a following wipe as said lead wipe is pulled through said feed slit.

2. The wipes dispenser of claim 1, wherein said bridge member is arcuate.

3. The wipes dispenser of claim 2, wherein said bridge member is a dome extending over said aperture.

4. The wipes dispenser of claim 1, wherein said feed plane extends at from 5 to 90 degrees relative to said aperture.

5. The wipes dispenser of claim 4, wherein said feed slit is sinusoidal, providing peaks and valleys that define wipe-spreading teeth, said sinusoidal feed slit being sinusoidal in a direction perpendicular to said feed plane.

6. The wipes dispenser of claim 1, wherein said feed slit is sinusoidal, providing peaks and valleys that define wipe-spreading teeth, said sinusoidal feed slit being sinusoidal in a direction perpendicular to said feed plane.

7. The wipes dispenser of claim 1, further comprising an anti-bunching boss surrounding and extending downwardly from said aperture toward said plurality of wipes, said wipes being pulled against said anti-bunching boss as they are pulled toward and through said feed slit, the pulling of said wipes against said anti-bunching boss urging a following wipe to remain behind its respective lead wipe to prevent wipes from bunching up at said feed slit.

8. The wipes dispenser of claim 1, wherein said feed plane extends such that said slit apex does not pass through said bridge apex.

9. The wipes dispenser of claim 8, wherein said container has a front and a rear and said feed plane extends in a direction away from said front of said container toward said rear of said container.

10. The wipes dispenser of claim 9, wherein said container includes a cap pivotally secured at said rear of said container and adapted to close over said bridge member, said cap further adapted to interfere with the pulling of a lead wipe in the direction of said rear of said container.

11. The wipes dispenser of claim 8, wherein said feed slit includes a top side and a bottom side, said wipes dispenser further comprising a lead wipe raked against said top side of said feed slit.

12. The wipes dispenser of claim 1, wherein said feed plane extends at from 20 to 70 degrees relative to said aperture.

13. The wipes dispenser of claim 1, wherein said feed slit consists of a single feed slit defining said slit apex and extending downwardly from said slit apex to said right-side terminal slit end and said left-side terminal slit end.

* * * * *